US007402236B2

(12) United States Patent
Miller et al.

(10) Patent No.: US 7,402,236 B2
(45) Date of Patent: Jul. 22, 2008

(54) PROCESS TO MAKE WHITE OIL FROM WAXY FEED USING HIGHLY SELECTIVE AND ACTIVE WAX HYDROISOMERIZATION CATALYST

(75) Inventors: Stephen J. Miller, San Francisco, CA (US); Susan M. Abernathy, Hercules, CA (US); John M. Rosenbaum, Richmond, CA (US)

(73) Assignee: Chevron USA, San Ramon, CA (US)

( * ) Notice: Subject to any disclaimer, the term of this patent is extended or adjusted under 35 U.S.C. 154(b) by 462 days.

(21) Appl. No.: 10/897,906

(22) Filed: Jul. 22, 2004

(65) Prior Publication Data

US 2006/0016724 A1 Jan. 26, 2006

(51) Int. Cl.

| | |
|---|---|
| ***C10G 73/02*** | (2006.01) |
| ***C10G 73/38*** | (2006.01) |
| ***C10G 73/42*** | (2006.01) |
| ***C10G 43/44*** | (2006.01) |
| ***C10G 73/00*** | (2006.01) |
| ***C10G 67/00*** | (2006.01) |

(52) U.S. Cl. ..... 208/27; 208/24; 208/28; 208/97

(58) Field of Classification Search ..... 208/24, 208/26, 27, 28, 29, 97
See application file for complete search history.

(56) References Cited

U.S. PATENT DOCUMENTS 4,943,672 A * 7/1990 Hamner et al. ..... 208/27
6,602,402 B1 8/2003 Benazzi et al.
2004/0014877 A1* 1/2004 Null ..... 524/577
2004/0065584 A1 4/2004 Bishop et al.
2004/0104145 A1 6/2004 Germaine

FOREIGN PATENT DOCUMENTS

WO PCT/WO 02/48290 A 6/2002
WO WO 2005/0124960 A 2/2005

* cited by examiner

*Primary Examiner*—Glenn Caldarola
*Assistant Examiner*—Randy Boyer
(74) *Attorney, Agent, or Firm*—Susan M. Abernathy

(57) ABSTRACT

A process for producing one or more white oils, by: a) hydroisomerization dewaxing a waxy feed with a defined composition over a highly selective and active wax hydroisomerization catalyst with a defined composition under conditions sufficient to produce a white oil; and b) collecting one or more white oils, wherein the yield of white oils is high, and they have a low pour point and a good Saybolt color. Also, a process for producing medicinal grade white oils, by a)hydroisomerization dewaxing a waxy feed with a defined composition over a highly selective and active wax hydroisomerization catalyst with a defined composition under conditions sufficient to produce a white oil, b) collecting technical grade white oils having a low pour point and good Saybolt color in high yield, and c) hydrofinishing the technical grade white oils at conditions sufficient to produce medicinal grade white oils that pass the RCS test.

39 Claims, 2 Drawing Sheets

PROCESS TO MAKE WHITE OIL FROM WAXY FEED USING HIGHLY SELECTIVE AND ACTIVE WAX HYDROISOMERIZATION CATALYST

FIELD OF THE INVENTION

The present invention relates to a process for producing one or more white oils from waxy feed using a highly selective and active wax hydroisomerization catalyst, and the composition of the white oils produced.

BACKGROUND OF THE INVENTION

White oils are essentially colorless. White oils may be either technical or medicinal grade. Technical white oils have a Saybolt color by ASTM D 156-02 of greater than +20. Medicinal grade white oils have a Saybolt color of greater than +25, more particularly equal to +30. Medicinal and technical white oil specifications require that the products have a low UV absorbance at different UV spectral ranges, as defined in FDA 178.3620 and FDA 178.3620. Medicinal grade white oils for use in food applications are required to have a kinematic viscosity at 100 degrees C. greater than 8.5 cSt and a 5 wt % boiling point greater than 391 degrees C.

White oils have high commercial value but generally are expensive to produce since they require a number of process steps including hydrocracking, high pressure hydrogen treatment, and treating by an adsorbent or a solvent. There is an incentive to produce oils which meet white oil specifications at lower processing cost. What is desired are processes not requiring hydrocracking, which will produce high quality technical and medicinal grade white oils in high yield. The desired processes would also reduce costs by requiring a lower hydrogen partial pressure for hydroisomerization dewaxing, and having a reduced number of process steps. What is also desired is a composition of white oil with high viscosity index, desired composition of molecules with cycloparaffin functionality, and low pour point, such that it may be used in a wide variety of applications.

The present invention provides solutions to shortcomings in the prior art, where white oils are either made using process steps that significantly reduce the yield of white oils that are produced out of waxy feed, utilize hydroisomerization dewaxing catalysts having low selectivity and activity, or require significant processing after catalytic dewaxing. Examples of processes that require hydrocracking prior to catalytic dewaxing, which would reduce the yield of white oils produced from a waxy feed are described in WO2004/000975, EP1382639A1, EP1366137, EP1366134, EP876446, WO200181508A1, WO200027950A1. Examples of processes that did not recognize the benefits associated with the use of highly selective and active hydroisomerization dewaxing catalysts under low hydrogen partial pressure to produce white oils at high yield without extensive processing after catalytic dewaxing are described in U.S. patent application Ser. Nos. 10/744,870 and 10/747,152, and U.S. Pat. No. 6,602,402. Other processes, such as U.S. 20040004021A1, teach how to make white oils with high viscosity indexes, but they are not appropriate when using waxy feeds having greater than 45 wt % n-paraffins and having very low sulfur and nitrogen; and/or the processes are not optimized to produce high yields of white oil from waxy feed.

SUMMARY OF THE INVENTION

The present invention is directed to a process for producing one or more white oils by:

a) hydroisomerization dewaxing a waxy feed over a highly selective and active wax hydroisomerization catalyst under condition sufficient to produce a white oil; wherein the highly selective and active wax hydroisomerization catalyst has: 1) a 1-D 10-ring molecular sieve having channels with a minimum crystallographic free diameter of not less than 3.9 Angstrom and a maximum crystallographic free diameter of not more than 6.0 Angstrom, and no channels with a maximum crystallographic free diameter greater than 6.0 Angstrom, 2) a noble metal hydrogenation component, and 3) a refractory oxide support; and wherein the waxy feed has: 1) a T90 boiling point greater than 490 degrees C. (915 degrees F.), 2) greater than 40 wt % n-paraffins, and 3) less than 25 ppm total combined nitrogen and sulfur; and b) collecting one or more white oils from the hydroisomerization step; wherein the yield of white oil boiling from 343 degrees C. and above (650° F.+) is greater than 25 wt % of the waxy feed, and the white oil produced has a pour point less than zero degrees C. and a Saybolt color of +20 or greater.

The present invention is also directed a process for producing one or more medicinal grade white oils by:

a) hydroisomerization dewaxing a waxy feed over a highly selective and active wax hydroisomerization catalyst under conditions sufficient to produce a white oil; wherein the highly selective and active hydroisomerization catalyst has a 1-D 10-ring molecular sieve having channels with a minimum crystallographic free diameter of not less than 3.9 Angstrom and a maximum crystallographic free diameter of not more than 6.0 Angstrom, an no channels with a maximum crystallographic free diameter greater than 6.0 Angstrom; and wherein the waxy feed has: 1) a T90 boiling point greater than 490 degrees C. (915 degrees F.), 2) greater than 40 weight percent n-paraffins, and 3) less than 25 ppm total combined nitrogen and sulfur;

b) collecting one or more technical grade white oils from the hydroisomerization dewaxing step, wherein: 1) the yield of the one or more technical grade white oils boiling from 343 degrees C. and above (650° F.+) is greater than 25 weight percent of the waxy feed, and 2) the one or more technical grade white oils produced have a pour point less than zero degrees C. and a Saybolt color of +20 or greater; and c) hydrofinishing the one or more technical grade white oils at conditions sufficient to produce one or more medicinal grade white oils that pass the RCS test.

The present invention is also directed to a white oil having: a) a kinematic viscosity at 100° C. between about 1.5 cSt and 36 cSt; b) a viscosity index greater than an amount calculated by the equation: Viscosity Index=28×Ln(the Kinematic Viscosity at 100° C.)+105; c) less than 18 wt % molecules with cycloparaffin functionality; d) a pour point less than zero degrees C.; and e) a Saybolt color of +20 or greater.

The present invention is also directed to a white oil having: a) a kinematic viscosity at 100° C. between about 1.5 and 36 cSt; b) a viscosity index greater than an amount calculated by the equation: Viscosity Index=28×Ln(the Kinematic Viscosity at 100° C.)+95; c) between 5 and less than 18 weight percent molecules with cycloparaffin functionality; d) less than 1.2 weight percent molecules with multicycloparaffin functionality, e) a pour point less than zero degrees C.; and f)

a Saybolt color of +20 or greater. The white oils of this invention are useful in a wide range of applications.

DETAILED DESCRIPTION OF THE INVENTION

Figure 1:
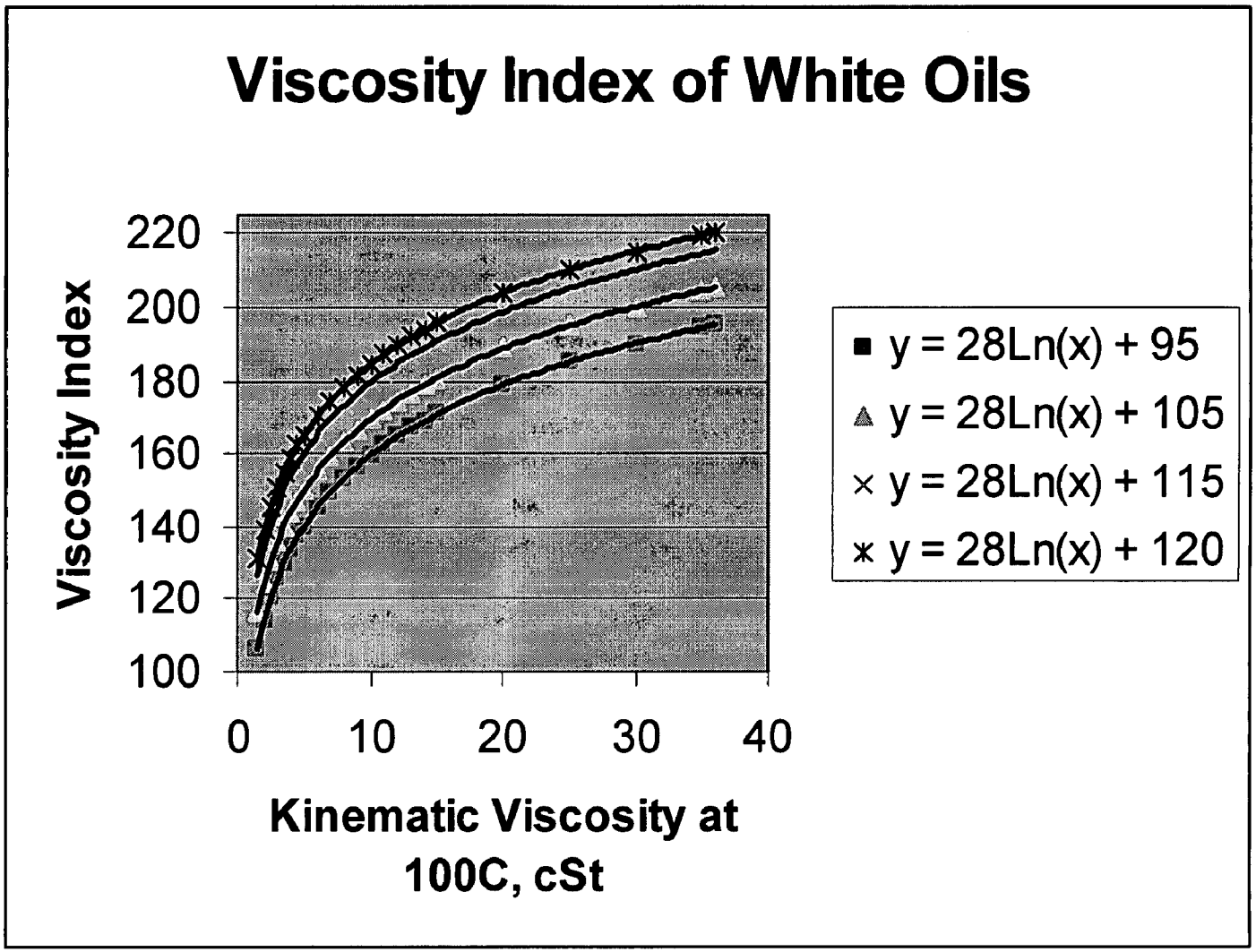
FIG. 1 illustrates the plots of the kinematic viscosity at 100° C. in cSt vs. viscosity index of the white oils of this invention. The lines define the lower limits of viscosity index for four different embodiments of the invention. The lines are natural logarithm functions with base "e" of the kinematic viscosity of the technical or medicinal white oil at 100° C. in cSt. The equations defining the four lines are shown in the figure.

The process of this invention produces white oils that meet technical and medicinal white oil specifications, as summarized below in Table I.

TABLE I

| | White Oil Specifications | |
|---|---|---|
| Product Property | Technical Grade White Oil FDA 178.362 (b) | Medicinal Grade White Oil FDA 178.3620 (c) |
| UV Absorbance by ASTM D 2269-99 | | |
| 280-289 nm | 4 max | 0.70 max |
| 290-299 nm | 3.3 max | 0.60 max |
| 300-329 nm | 2.3 max | 0.40 max |
| 330-380 nm | 0.8 max | 0.09 max |
| Saybolt Color by ASTM D156-02 | >+20 | +30 |

The properties of a medicinal grade white oil are described by the following standards: European Pharmacopeia 3.sup.rd Edition; US Pharmacopeia 23.sup.rd edition; US FDA specification CFR section 172.927 for "direct" food use; and US FDA specification CFR section 178.3620(a) for "indirect" food contact. Medicinal grade white oils must be chemically inert and substantially without color, odor, or taste. For medicinal grade white oil applications manufacturers must remove "readily carbonizable substances" (RCS) from the white oil. RCS are impurities that cause the white oil to change color when treated with strong acid. The Food and Drug Administration (FDA) and white oil manufacturers have stringent standards with respect to RCS, which must be met before the white oil can be marketed for use in food or pharmaceutical applications. The RCS test in this invention is conducted according to ASTM D 565-99. The white oil is treated with concentrated sulfuric acid under prescribed conditions and the resulting color is compared with a reference standard to determine whether it passes or fails the test. A white oil is reported as passing the RCS test when the oil layer shows no change in color and when the acid layer is not darker than the reference standard colorimetric solution.

Selection of Waxy Feed:

The waxy feeds useful in this invention have a high boiling range, with a T90 boiling point greater than 490 degrees C. (915 degrees F.). In addition they have a high level of n-paraffins, generally greater than 40 wt %, preferably greater than 50 wt %, more preferably greater than 75 wt %. They also have very low levels of nitrogen and sulfur, generally less than 25 ppm total combined nitrogen and sulfur; preferably less than 20 ppm. Examples of waxy feeds that may meet these properties are slack waxes, deoiled slack waxes, refined foots oil, waxy lubricant raffinates, n-paraffin waxes, NAO waxes, waxes produced in chemical plant processes, deoiled petroleum derived waxes, microcrystalline waxes, Fischer-Tropsch waxes, and mixtures thereof. The pour points of the waxy feeds useful in this invention are greater than 50° C., preferably greater than 60° C.

The waxy feed useful in this invention has a high boiling range. The T90 boiling point of the waxy feed is greater than 490 degrees C. (915 degrees F.). For greater yields of white oils with kinematic viscosities at 100 degrees C. greater than 4 cSt, it is preferable to use a waxy feed with an even higher boiling range. Preferably the T90 of the wax is greater than 510 degrees C. (950 degrees F.). For high yields of white oils with kinematic viscosities greater than about 8.5 cSt the waxy feed should have an even higher boiling range, preferably greater than 565 degrees C. (1050 degrees F.). Examples of processes producing waxy feeds of higher viscosity from Fischer-Tropsch processes are taught in W0199934917A1. The waxes made from these processes will have a T90 boiling point greater than 510 or 565 degrees C.; and have a weight ratio of molecules having at least 60 or more carbon atoms and molecules having at least 30 carbon atoms greater than 0.20, or greater than 0.40.

Preferred waxy feeds have high levels of n-paraffins and are low in oxygen, nitrogen, sulfur, and elements such as aluminum, cobalt, titanium, iron, molybdenum, sodium, zinc, tin, and silicon. The preferred waxy feeds useful in this invention have greater than 40 weight percent n-paraffins, less than 1 weight percent oxygen, less than 25 ppm total combined nitrogen and sulfur, and less than 25 ppm total combined aluminum, cobalt, titanium, iron, molybdenum, sodium, zinc, tin, and silicon. More preferred waxy feeds have greater than 50 weight percent n-paraffins, less than 0.8 weight percent oxygen, less than 20 ppm total combined nitrogen and sulfur, and less than 20 ppm total combined aluminum, cobalt, titanium, iron, molybdenum, sodium, zinc, tin, and silicon. Most preferred waxy feeds have greater than 75 weight percent n-paraffins, less than 0.8 weight percent oxygen, less than 20 ppm total combined nitrogen and sulfur, and less than 20 ppm total combined aluminum, cobalt, titanium, iron, molybdenum, sodium, zinc, tin, and silicon.

Analytical Test Methods for Characterizing Waxy Feeds:

T90 boiling points are measured by simulated distillation by ASTM D 6352 or an equivalent method. An equivalent test method refers to any analytical method which gives substantially the same results as the standard method. T90 refers to the temperature at which 90 weight percent of the wax has a lower boiling point. The nitrogen is measured by melting the wax prior to oxidative combustion and chemiluminescence detection by ASTM D 4629-96. The sulfur is measured by melting the wax prior to ultraviolet fluorescence by ASTM D 5453-00. The test methods for measuring nitrogen and sulfur are further described in U.S. Pat. No. 6,503,956.

Oxygen content in the waxy feed is measured by neutron activation. The technique used to do the elemental analysis for aluminum, cobalt, titanium, iron, molybdenum, sodium, zinc, tin, and silicon is inductively coupled plasma atomic emission spectroscopy (ICP-AES). In this technique, the sample is placed in a quartz vessel (ultra pure grade) to which is added sulfuric acid, and the sample is then ashed in a programmable muffle furnace for 3 days. The ashed sample is then digested with HCl to convert it to an aqueous solution prior to ICP-AES analysis. The oil content of the most preferred waxy feeds is less than 10 weight percent as determined by ASTM D 721-02.

Determination of Weight Percent Normal Paraffins in Waxy Feed:

Determination of normal paraffins (n-paraffins) in wax-containing samples should use a method that can determine the content of individual C7 to C110 n-paraffins with a limit of detection of 0.1 wt %. The preferred method used is as follows. Quantitative analysis of normal paraffins in wax is determined by gas chromatography (GC). The GC (Agilent 6890 or 5890 with capillary split/splitless inlet and flame ionization detector) is equipped with a flame ionization detector, which is highly sensitive to hydrocarbons. The method utilizes a methyl silicone capillary column, routinely used to separate hydrocarbon mixtures by boiling point. The column is fused silica, 100% methyl silicone, 30 meters length, 0.25 mm ID, 0.1 micron film thickness supplied by Agilent. Helium is the carrier gas (2 ml/min) and hydrogen and air are used as the fuel to the flame.

The waxy feed is melted to obtain a 0.1 g homogeneous sample. The sample is immediately dissolved in carbon disulfide to give a 2 wt % solution. If necessary, the solution is heated until visually clear and free of solids, and then injected into the GC. The methyl silicone column is heated using the following temperature program:

Initial temp: 150° C. (If C7 to C15 hydrocarbons are present, the initial temperature is 50° C.)

Ramp: 6° C. per minute

Final Temp: 400° C.

Final hold: 5 minutes or until peaks no longer elute

The column then effectively separates, in the order of rising carbon number, the normal paraffins from the non-normal paraffins. A known reference standard is analyzed in the same manner to establish elution times of the specific normal-paraffin peaks. The standard is ASTM D2887 n-paraffin standard, purchased from a vendor (Agilent or Supelco), spiked with 5 wt % Polywax 500 polyethylene (purchased from Petrolite Corporation in Oklahoma). The standard is melted prior to injection. Historical data collected from the analysis of the reference standard also guarantees the resolving efficiency of the capillary column.

If present in the sample, normal paraffin peaks are well separated and easily identifiable from other hydrocarbon types present in the sample. Those peaks eluting outside the retention time of the normal paraffins are called non-normal paraffins. The total sample is integrated using baseline hold from start to end of run. N-paraffins are skimmed from the total area and are integrated from valley to valley. All peaks detected are normalized to 100%. EZChrom is used for the peak identification and calculation of results.

Fischer-Tropsch Wax:

Fischer-Tropsch wax is a preferred waxy feed for use in this invention. Fischer-Tropsch wax is a product of Fischer-Tropsch synthesis. During Fischer-Tropsch synthesis liquid and gaseous hydrocarbons are formed by contacting a synthesis gas comprising a mixture of hydrogen and carbon monoxide with a Fischer-Tropsch catalyst under suitable temperature and pressure reactive conditions. The Fischer-Tropsch reaction is typically conducted at temperatures of from about 300 degrees to about 700 degrees F. (about 150 degrees to about 370 degrees C.) preferably from about 400 degrees to about 550 degrees F. (about 205 degrees to about 230 degrees C.); pressures of from about 10 to about 600 psia (0.7 to 41 bars), preferably 30 to 300 psia (2 to 21 bars), and catalyst space velocities of from about 100 to about 10,000 cc/g/hr., preferably 300 to 3,000 cc/g/hr.

The products from the Fischer-Tropsch synthesis may range from C1 to C200 plus hydrocarbons, with a majority in the C5-C100 plus range. The Fischer-Tropsch reaction can be conducted in a variety of reactor types, such as, for example, fixed bed reactors containing one or more catalyst beds, slurry reactors, fluidized bed reactors, or a combination of different types of reactors. Such reaction processes and reactors are well known and documented in the literature. A particularly preferred Fischer-Tropsch process is taught in EP0609079, completely incorporated herein by reference for all purposes.

Suitable Fischer-Tropsch catalysts comprise one or more Group VIII catalytic metals such as Fe, Ni, Co, Ru, and Re, with cobalt being preferred. Additionally, a suitable catalyst may contain a promoter. Thus a preferred Fischer-Tropsch catalyst comprises effective amounts of cobalt and one or more of Re, Ru, Pt, Fe, Ni, Th, Zr, HF, U, Mg, and La on a suitable inorganic support material, preferably one which comprises one or more refractory metal oxides. In general, the amount of cobalt present in the catalyst is between about 1 and about 50 weight percent of the total catalyst composition. The catalysts can also contain basic oxide promoters such as ThO2, La2O3, MgO, and TiO2, promoters such as ZrO2, noble metals (Pt, Pd, Ru, Rh, Os, Ir), coinage metals (Cu, Ag, Au), and other transition metals such as Fe, Mn, Ni, and Re. Suitable support materials include alumina, silica, magnesia and titania, or mixtures thereof. Preferred supports for cobalt containing catalysts comprise titania. Useful catalysts and their preparation are known and illustrated in U.S. Pat. Nos. 4,568,663 and 6,130,184.

Highly Selective and Active Wax Hydroisomerization Catalyst:

According to the present invention, the waxy feed is hydroisomerization dewaxed over a highly selective and active wax hydroisomerization catalyst under conditions sufficient to produce one or more white oils. Preferably the hydroisomerization dewaxing is done at a hydrogen partial pressure greater than 0.69 MPa (100 psia) and less than 6.55 MPa (950 psia) to produce the one or more white oils.

A highly selective and active wax hydroisomerization catalyst comprises: a) a 1-D 10-ring molecular sieve having channels with a minimum crystallographic free diameter of not less than 3.9 Angstrom and a maximum crystallographic free diameter of not more than 6.0 Angstrom, and no channels with a maximum crystallographic free diameter greater than 6.0 Angstrom; b) a noble metal hydrogenation component; and c) a refractory oxide support. Preferably, the 1-D 10-ring molecular sieve has channels with a minimum crystallographic free diameter of not less than 3.9 Angstrom and a maximum crystallographic free diameter of not more than 5.7 Angstrom. More preferably, the 1-D 10 ring molecular sieve has channels with a minimum crystallographic free diameter of not less than 3.9 Angstrom and a maximum crystallographic free diameter of not more than 5.4 Angstrom. The crystallographic free diameters of the channels of molecular sieves are published in the "Atlas of Zeolite Framework Types", Fifth Revised Edition, 2001, by Ch. Baerlocher, W. M. Meier, and D. H. Olson, Elsevier, pp 10-15, which is incorporated herein by reference.

If the crystallographic free diameters of the channels of a molecular sieve are unknown, the effective pore size of the molecular sieve can be measured using standard adsorption techniques and hydrocarbonaceous compounds of known minimum kinetic diameters. See Breck, Zeolite Molecular Sieves, 1974 (especially Chapter 8); Anderson et al. J. Catalysis 58, 114 (1979); and U.S. Pat. No. 4,440,871, the pertinent portions of which are incorporated herein by reference. In performing adsorption measurements to determine pore size, standard techniques are used. It is convenient to consider a particular molecule as excluded if does not reach at least 95% of its equilibrium adsorption value on the molecular sieve in less than about 10 minutes (p/po=0.5; 25° C.). Highly selective and active wax hydroisomerization catalysts will typically admit molecules having kinetic diameters of 4.5 to 5.3 Angstrom with little hindrance.

The preferred 1-D 10 ring molecular sieves of this invention are ZSM48, MTT, TON, EUO, MFS and FER group types of molecular sieves. Mixtures of these group types of molecular sieves are also preferred. More preferably they are SSZ-32, ZSM-23, ZSM-22, ZSM-35, ZSM48, ZSM-57 and mixtures thereof. The most preferred molecular sieves are SSZ-32, ZSM-23, ZSM-22, and mixtures thereof.

In a preferred embodiment, the highly selective and active wax hydroisomerization catalyst has sufficient acidity so that 0.5 grams thereof when positioned in a tube reactor converts at least 50% of hexadecane at 370° C., a pressure of 1200 psig, a hydrogen flow of 160 ml/min, and a feed rate of 1 ml/hr. The catalyst also exhibits hydroisomerization selectivity of 40% or greater. Hydroisomerization selectivity is determined as follows: 100×(weight percent branched $C_{16}$ in product)/(weight percent branched $C_{16}$ in product +weight percent $C_{13}$ in product) when used under conditions leading to 96% conversion of normal hexadecane (n-$C1_6$) to other species.

The highly selective and active wax hydroisomerization catalyst has a catalytically active noble metal hydrogenation component. The presence of a catalytically active noble metal leads to product improvement, especially viscosity index and stability. The noble metals are Ru, Rh, Pd, Re, Os, Ir, Pt, and Au. Preferably the noble metal is a Group VIII metal, or those noble metals other than Re. The preferred Group VIII noble metals are platinum, palladium, and mixtures thereof. If platinum and/or palladium is used, the total amount of active metal is typically in the range of 0.1 to 5 weight percent of the total catalyst, usually from 0.1 to 2 weight percent, and not to exceed 10 weight percent.

The refractory oxide support may be selected from those oxide supports which are conventionally used for catalysts, including silica, alumina, silica-alumina, magnesia, titania, and combinations thereof.

Examples of the highly selective and active wax hydroisomerization catalysts of this invention are shown in Table II. Note that the specific crystallographic free diameters of the zeolite channels shown are those of the first zeolite listed. However, zeolites of the same framework type code will have diameters close to those shown.

TABLE II

Highly Selective and Active Wax Hydroisomerization Catalysts

| Framework Type Code | Examples | First Channel Orientation | Crystallographic Free Diameters of the Zeolite Channels | Number of T or O Atoms forming Rings |
|---|---|---|---|---|
| EUO | EU-1, ZSM-50 | [100] | 4.1 × 5.4* | 10 |
| FER | Ferrierite, ZSM-35, NU-23 | [001] | 4.2 × 5.4* <--> 3.5 × 4.8* | 10, 8 |
| LAU | Laumontite | [100] | 4.0 × 5.3* | 10 |
| MTT | ZSM-23, EU-13, ISI-4, KZ-1, SSZ-32 | [001] | 4.5 × 5.2* | 10 |
| MFS | ZSM-57 | [100] | 5.1 × 5.4* <--> 3.3 × 4.8* | 10, 8 |
| SFF | SSZ-44 | [001] | 5.4 × 5.7* | 10 |
| STF | SSZ-35 | [001] | 5.4 × 5.7* | 10 |
| TON | Theta-1, ZSM-22, NU-10, ISI-1, KZ-2 | [001] | 4.6 × 5.7* | 10 |
| | ZSM-48, EU-2, ZBM-30, EU-11 | | 5.3 × 5.6* | 10 |

*one dimensional, or 1-D.

Examples of molecular sieves that are not useful in this invention, and do not meet the definition of highly selective and active wax hydroisomerization catalysts are shown below in Table III for comparison.

TABLE III

Wax Hydroisomerization Catalysts That are Not Highly Selective and Active

| Framework Type Code | Comparative Examples | First Channel Orientation | Crystallographic Free Diameters of the Zeolite Channels | Number of T or O Atoms forming Rings |
|---|---|---|---|---|
| AEL | AlPO-11, SAPO-11, MnAPO-11, SM-3 | [001] | 4.0 × 6.5* | 10 |
| TER | Terranovaite | [100] | 5.0 × 5.0* <--> 4.1 × 7.0* | 10, 10 |

*one dimensional, or 1-D.

Note that FER, MTT, and TON have smaller crystallographic free diameters than AEL and some other comparison framework types. Because of this they are more selective than AEL. FER, MTT and TON molecular sieves are less likely to produce oils with ring structures that may produce color and require more processing to make white oils.

Hydroisomerization Dewaxing Conditions:

The conditions under which the hydroisomerization dewaxing with the highly selective and active wax hydroisomerization catalyst may be carried out include temperatures below about 357 degrees C. (675 degrees F.). Preferred temperature ranges are from about 260 degrees C. (500 degrees F.) to about 357 degrees C. (675 degrees F.), more preferably about 288 degrees C. (550 degrees F.) to about 343 degrees C.

(650 degrees F.). The hydrogen partial pressure is from about 0.1 MPa (14.5 psia) to less than about 6.55 MPa (950 psia). Preferably the hydrogen partial pressure during hydroisomerization dewaxing is from about 1.38 MPa (200 psia) to less than about 5.52 MPa (800 psia); more preferably from about 1.72 MPa (250 psia) to less than about 3.45 MPa (500 psia). The hydroisomerization dewaxing under lower pressures provides enhanced hydroisomerization selectivity, which results in more hydroisomerization and less cracking of the feed, thus producing an increased yield of base oil products with higher viscosity indexes. Low pressure hydroisomerization dewaxing is described more fully in U.S. patent application Ser. No. 10/747,152 and U.S. Pat. No. 6,337,010, the contents of which are incorporated by reference in their entirety. The hydroisomerization dewaxing pressures in this context refer to the hydrogen partial pressure within the reactor, although the hydrogen partial pressure is substantially the same (or nearly the same) as the total pressure.

Hydrogen is present in the hydroisomerization dewaxing reactor, typically in a hydrogen to feed ratio from about 500 standard cubic feet per barrel (SCF/bbl) to about 20,000 SCF/bbl, preferably from about 1,000 SCF/bbl to about 10,000 SCF/bbl. Generally, hydrogen will be separated from the product and recycled to the hydroisomerization dewaxing reactor.

The liquid hourly space velocity (LHSV) in the hydroisomerization dewaxing reactor is generally from about 0.2 to about 10 $hr^{-1}$, preferably from about 0.5 to about 5 $hr^{-1}$. The hydrogen to hydrocarbon ratio falls within a range from about 1.0 to about 50 moles $H_2$ per mole hydrocarbon, more preferably from about 10 to about 20 moles $H_2$ per mole hydrocarbon. Suitable conditions for performing hydroisomerization dewaxing are described in U.S. Pat. Nos. 5,282,958 and 5,135,638, the contents of which are incorporated by reference in their entirety.

The conversion of the hydrocarbons boiling at 343 degrees C. and higher (650° F.+) in the waxy feed to products boiling at 343 degrees C. and lower (650° F.−) during the hydroisomerization dewaxing (and any following process steps) is preferably greater than 20 wt % and less than 75 wt %, more preferably greater than 20 wt % and less than 60 wt %.

Hydrotreating:

Hydrotreating refers to a catalytic process, usually carried out in the presence of free hydrogen, in which the primary purpose is the removal of various metal contaminants, such as iron, arsenic, aluminum, and cobalt; heteroatoms, such as sulfur and nitrogen; oxygenates; or aromatics from the feed stock. Generally, in hydrotreating operations cracking of the hydrocarbon molecules, i.e., breaking the larger hydrocarbon molecules into smaller hydrocarbon molecules, is minimized, and the unsaturated hydrocarbons are either fully or partially hydrogenated. The waxy feed used in the process of this invention is preferably hydrotreated prior to hydroisomerization dewaxing.

Catalysts used in carrying out hydrotreating operations are well known in the art. See for example U.S. Pat. Nos. 4,347,121 and 4,810,357, the contents of which are hereby incorporated by reference in their entirety, for general descriptions of hydrotreating, hydrocracking, and of typical catalysts used in each of the processes. A number of patents teach catalysts suitable for hydrogenation of base oils to produce high quality white oils, including: EP672452, EP0097047A3, EP290100, EP0042461, and EP672452. Suitable catalysts include noble metals from Group VIIIA (according to the 1975 rules of the International Union of Pure and Applied Chemistry), such as platinum or palladium on an alumina or siliceous matrix, and Group VIII and Group VIB, such as nickel-molybdenum or nickel-tin on an alumina or siliceous matrix. U.S. Pat. No. 3,852,207 describes a suitable noble metal catalyst and mild conditions. Other suitable catalysts are described, for example, in U.S. Pat. Nos. 4,157,294 and 3,904,513. The non-noble hydrogenation metals, such as nickel-molybdenum, are usually present in the final catalyst composition as oxides, but are usually employed in their reduced or sulfided forms when such sulfide compounds are readily formed from the particular metal involved. Preferred non-noble metal catalyst compositions contain in excess of about 5 weight percent, preferably about 5 to about 40 weight percent molybdenum and/or tungsten, and at least about 0.5, and generally about 1 to about 15 weight percent of nickel and/or cobalt determined as the corresponding oxides. Catalysts containing noble metals, such as platinum, contain in excess of 0.01 percent metal, preferably between 0.1 and 1.0 percent metal. Combinations of noble metals may also be used, such as mixtures of platinum and palladium.

Typical hydrotreating conditions vary over a wide range. In general, the overall LHSV is about 0.25 to 2.0, preferably about 0.5 to 1.5. The hydrogen partial pressure is greater than 200 psia, preferably ranging from about 500 psia to about 2000 psia. Hydrogen recirculation rates are typically greater than 50 SCF/Bbl, and are preferably between 1000 and 5000 SCF/Bbl. Temperatures in the reactor will range from about 300 degrees F. to about 750 degrees F. (about 150 degrees C. to about 400 degrees C.), preferably ranging from 450 degrees F. to 725 degrees F. (230 degrees C. to 385 degrees C.). In one embodiment of this invention the preferred hydrotreating conditions are selected such that the conversion of hydrocarbons in the waxy feed boiling at 343° C.+(650° F.+) to hydrocarbons in the waxy feed boiling below 343° C. (650° F.) during the hydrotreating is less than 20 weight percent, preferably less than 5 weight percent.

Hydrofinishing:

Hydrotreating may be used as a step following hydroisomerization dewaxing in the process of this invention to make white oils with improved properties. This step, herein called hydrofinishing, is intended to improve the oxidation stability, UV stability, and appearance of the product by removing traces of aromatics, olefins, and color bodies. As used in this disclosure, the term UV stability refers to the stability of the lubricating base oil or the finished lubricant when exposed to UV light and oxygen. Instability is indicated when a visible precipitate forms, usually seen as floc or cloudiness, or a darker color develops upon exposure to ultraviolet light and air. A general description of hydrofinishing may be found in U.S. Pat. Nos. 3,852,207 and 4,673,487. In one embodiment the dewaxed product from the hydroisomerization dewaxing reactor passes directly to the hydrofinishing reactor.

Due to the high quality of the products from the hydroisomerization step, mild hydrofinishing, when used, may be conducted under much lower pressures than would be required by conventional processes to make white oils. The mild hydrofinishing is conducted at a total pressure less than 3.45 MPa (500 psig). High quality white oils may even be produced under such mild hydrofinishing total pressures as from about 1.38 MPa (200 psig) to about 3.45 MPa (500 psig). Without any further processing, one or more white oils with good Saybolt color and low pour point are collected at high yield either with or without mild hydrofinishing.

In a preferred embodiment the mild hydrofinishing is conducted at a hydrogen partial pressure that is essentially the same as that used for hydroisomerization dewaxing. Essentially the same partial pressure means that the difference between the two partial pressures is less than 0.69 MPa (100 psia). There might be small amounts of hydrogen partial pressure drop in the equipment, especially between the two reactors. The difference in the total pressure between the two reactors will also be essentially the same. That is, preferably the difference in pressure between the two reactors is less than 0.69 MPa (100 psig). Operating the hydroisomerization dewaxing and hydrofinishing reactors at essentially the same pressure reduces equipment costs and streamlines the operation.

Optionally, the one or more white oils collected after hydroisomerization dewaxing (either with no hydrofinishing or with mild hydrofinishing) may be subsequently hydrofinished to further improve their Saybolt color and UV absorbance. The subsequent hydrofinishing is conducted at a total pressure of from about 1.38 MPa (200 psig) to about 10.34 MPa (1500 psig), preferably from about 1.72 MPA (250 psig) to about 8.28 MPa (1200 psig). The total pressure during the subsequent hydrofinishing may be selected to be adequate to change technical grade white oil that does not pass the RCS test to medicinal grade white oil that passes the RCS test.

The optional mild and subsequent hydrofinishing steps of this invention are conducted at a temperature from about 176 degrees C. (350 degrees F.) to about 288 degrees C. (550 degrees F.), preferably from about 204 degrees C. (400 degrees F.) to about 260 degrees C. (500 degrees F.). The liquid hour space velocity in the mild or subsequent hydrofinishing reactor is from about 0.2 to about 10 $hr^{-1}$, preferably from about 0.5 to about 5 $hr^{-1}$. Preferably the hydrofinishing catalyst for either mild or subsequent hydrofinishing comprises a noble metal; with platinum, palladium, or mixtures thereof being the preferred noble metals used.

Distilling:

Optionally, the process of this invention may include distilling the hydroisomerization dewaxed product before or after collecting one or more white oils to remove a high boiling bottoms cut. In addition, the process may include distilling the white oil into more than one viscosity grade, whereby more than one white oil may be collected. The distilling is generally accomplished by either atmospheric or vacuum distillation, or by a combination of atmospheric and vacuum distillation. Atmospheric distillation is typically used to separate the lighter distillate fractions, such as naphtha and middle distillates, from a bottoms fraction having an initial boiling point about 315 degrees C. (600 degrees F.) to about 399 degrees C. (750 degrees F.). At higher temperatures thermal cracking of the hydrocarbons may take place leading to fouling of the equipment and to lower yields of white oil. Vacuum distillation is typically used to separate the white oil into different boiling range cuts. Distilling the white oil into different boiling range cuts enables the production of more than one grade, or viscosity, of white oil. Vacuum distillation may also be used to remove a high boiling bottoms cut of white oil that may have less desired Saybolt color than the other light boiling distillate fractions.

Adsorbent Treatment:

Optionally, the white oils of this invention may be contacted with a heterogeneous adsorbent to reduce the UV absorbance and increase the Saybolt color. In this manner a technical grade white oil may be upgraded to a medicinal grade white oil. In one embodiment the entire boiling range of white oil produced may be contacted with a heterogeneous adsorbent. Optionally, a high boiling bottoms cut, or one or more distillate fractions of different viscosity grades may be treated with a heterogeneous adsorbent. Examples of suitable heterogeneous adsorbents are activated carbon, crystalline molecular sieves, zeolites, silica-alumina, metal oxides, and clays. Preferred adsorbents are taught in WO 2004/000975, EP 278693A, and U.S. Pat. No. 6,468,418, herein incorporated in their entirety.

White Oil Yields and Characteristics:

The yields of the one or more white oils produced from the process of this invention are very high. The high yields are due to a combination of factors, including: 1) the initial selection of high boiling, highly paraffinic and low nitrogen and sulfur containing waxy feed, 2) a process not requiring hydrocracking, 3) the high selectivity and activity of the hydroisomerization dewaxing catalyst, and 4) the generally mild process conditions required during hydroisomerization dewaxing. Generally the yield of one or more white oils boiling from 343 degrees C. (650 degrees F.) and above is greater than 25 wt % of the waxy feed, preferably greater than 35 wt %, and more preferably greater than 45 wt %.

The white oils produced by the process of this invention have a Saybolt color of +20 or greater by ASTM D 156-$O_2$, preferably +25 or greater, more preferably +29 or greater, most preferably +30. They have a high viscosity index, preferably greater than an amount calculated by the equation: Viscosity Index=28×Ln(the Kinematic Viscosity at 100° C.)+95. For example, a white oil produced by the process of this invention with a kinematic viscosity at 100 degrees C. of 3 cSt will preferably have a VI greater than 126. Kinematic Viscosity at 100° C. is measured by ASTM D 445-03 and is reported in centistokes (cSt). Ln(the Kinematic Viscosity at 100° C.) is the natural logarithm with base "e" of the Kinematic Viscosity at 100° C. More preferably the viscosity index is greater than 28×Ln(the Kinematic Viscosity at 100° C.)+105, or +115; and most preferably the viscosity index is greater than 28×Ln(the Kinematic Viscosity at 100° C.)+120. The test method used to measure viscosity index is ASTM D 2270-93 (1998). The lines defining the four preferred ranges of viscosity index of the one or more white oils of this invention, as described above, are shown in FIG. 1.

The white oils of this invention have greater than 95 weight percent saturates as determined by elution column chromatography, ASTM D 2549-02. Olefins are present in amounts less than detectable by long duration $C_{13}$ Nuclear Magnetic Resonance Spectroscopy (NMR). The white oils produced by the process of this invention have a desired composition of molecules with cycloparaffin functionality. They have less than 18 weight percent total of molecules with cycloparaffin functionality. Typically, they will have between 5 and less than 18 weight percent molecules with cycloparaffin functionality, more typically they will have between 8 and 15 weight percent molecules with cycloparaffin functionality. They will also have a very low weight percent of molecules with multicycloparaffin functionality. Preferably the weight percent of molecules with multicycloparaffin functionality is less than 1.2, more preferably less than 0.8, most preferably less than 0.01.

The composition of molecules with cycloparaffin and multicycloparaffin composition are determined using Field Ionization Mass Spectroscopy (FIMS). FIMS spectra were obtained on a VG 70VSE mass spectrometer.

The samples were introduced via solid probe, which was heated from about 40° C. to 500° C. at a rate of 50° C. per minute. The mass spectrometer was scanned from m/z 40 to m/z 1000 at a rate of 5 seconds per decade. The acquired mass spectra were summed to generate one "averaged" spectrum. Each spectrum was $C_{13}$ corrected using a software package from PC-MassSpec. FIMS ionization efficiency was evaluated using blends of nearly pure branched paraffins and highly naphthenic, aromatics-free base stock. The ionization efficiencies of iso-paraffins and cycloparaffins in these base oils were essentially the same. Iso-paraffins and cycloparaffins comprise more than 99.9% of the saturates in the white oils of this invention.

The white oils of this invention are characterized by FIMS into paraffins and molecules with different numbers of unsaturations. The molecules with different numbers of unsaturations may be comprised of cycloparaffins, olefins, and aromatics. As the white oils of this invention have very low levels of aromatics and olefins, the molecules with different numbers of unsaturations may be interpreted as being cycloparaffins with different numbers of rings. Thus, for the white oils of this invention, the 1-unsaturations are monocycloparaffins, the 2-unsaturations are dicycloparaffins, the 3-unsaturations are tricycloparaffins, the 4-unsaturations are tetracycloparaffins, the 5-unsaturations are pentacycloparaffins, and the 6-unsaturations are hexacycloparaffins. If aromatics were present in significant amounts in the white oil they would be identified in the FIMS analysis as 4-unsaturations. The total of the 2-unsaturations, 3-unsaturations, 4-unsaturations, 5-unsaturations, and 6-unsaturations in the white oils of this invention are the weight percent of molecules with multicycloparaffin functionality. The total of the 1-unsaturations in the white oils of this invention are the weight percent of molecules with monocycloparaffin functionality.

The white oils produced by the process of this invention have a low pour point, generally less than zero degrees C. Preferably the pour point is less than −10 degrees C., more preferably the pour point is less than −20 degrees C. Pour point is measured in one degree increments by ASTM D 5950-02. The results are reported in degrees Celsius. The white oils have a kinematic viscosity at 100° C. between about 1.5 cSt and 36 cSt. The white oils may have kinematic viscosities at 40° C. between about 4 cSt and about 240 cSt, the viscosity range depending on the boiling range of the waxy feed and the distillations that may be performed on the white oils The white oils produced by the process of this invention have a low content of aromatics, preferably less than 0.05 weight percent, more preferably 0.01 weight percent or less. The HPLC-UV test method used to measure low level aromatics is described in D. C. Kramer, et al., "Influence of Group II & III Base Oil Composition on VI and Oxidation Stability," presented at the 1999 AIChE Spring National Meeting in Houston, Mar. 16, 1999, and in U.S. patent application Ser. No. 10/744,389, the contents of which are incorporated herein in their entirety.

The white oils of this invention will meet the UV absorbance requirements of either technical or medicinal grade white oils. Preferably, the UV absorbance of the white oils of this invention between 280 to 289 nm is 3.5 or less, the UV absorbance between 290 and 299 nm is 3.0 or less, the UV absorbance between 300 and 329 nm is 2.0 or less, and the UV absorbance between 330 and 380 nm is 0.7 or less. More preferably, the UV absorbance of the white oils of this invention between 280 to 289 nm is 0.70 or less, the UV absorbance between 290 and 299 nm is 0.60 or less, the UV absorbance between 300 and 329 nm is 0.40 or less, and the UV absorbance between 330 and 380 nm is 0.09 or less. The UV absorbance is measured using ASTM D 2269-99.

Figure 2:
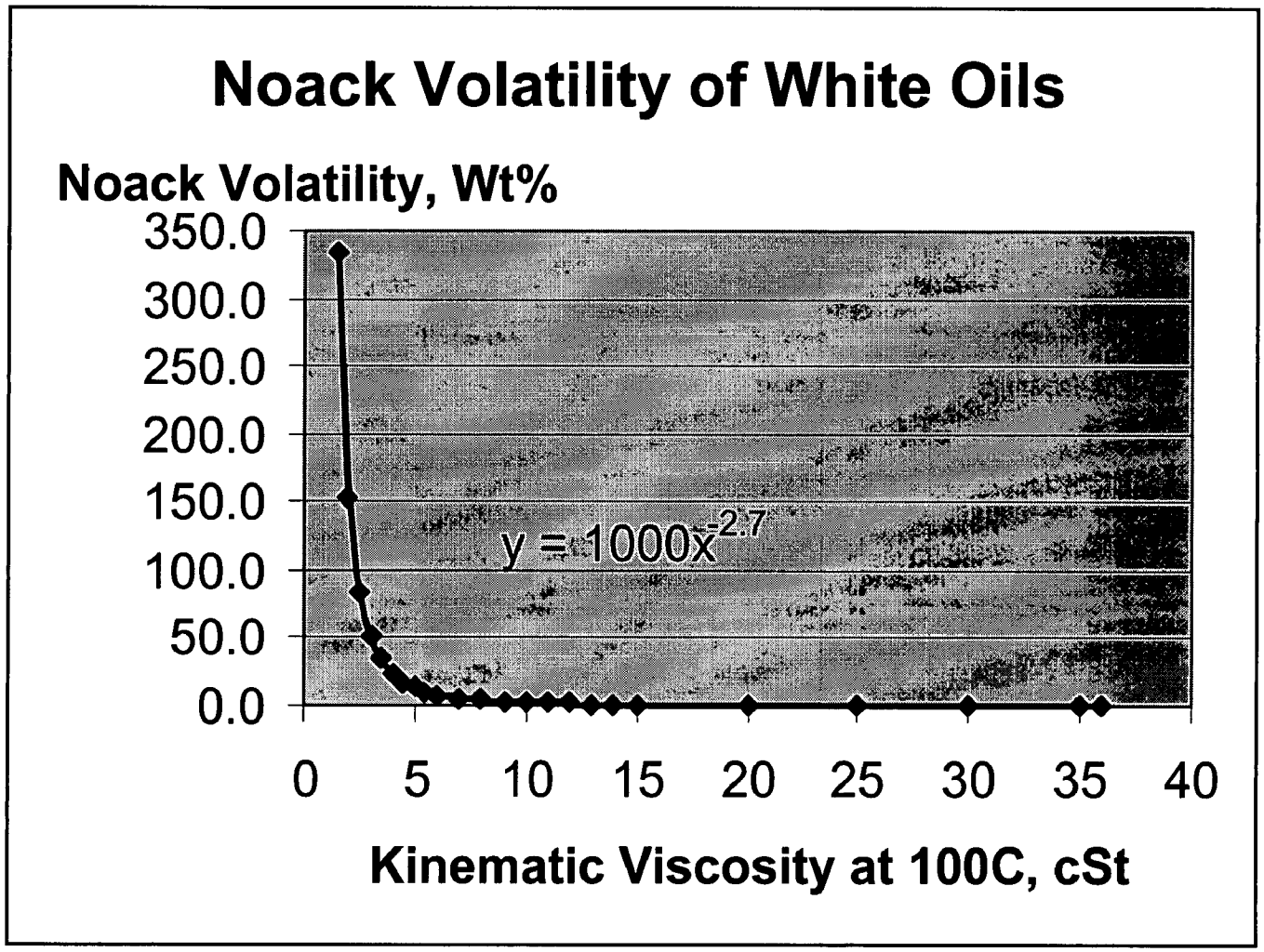
FIG. 2 illustrates the plot of kinematic viscosity at 100° C. vs. Noack Volatility in weight percent. The line defines the preferred upper limits of Noack Volatility for the white oils of this invention. The Noack Volatility is less than an amount calculated by the equation: Noack Volatility, wt %=1000×(the kinematic viscosity of the technical or medicinal white oil at 100° C., in cSt) raised to the power of −2.7.

The white oils produced by the process of this invention in preferred embodiments have a low Noack volatility, generally less than an amount calculated from the equation: Noack Volatility, wt %=1000×(the Kinematic Viscosity at 100° C.)$^{-2.7}$, wherein the Kinematic Viscosity at 100° C., in cSt, is raised to the power of −2.7. For example, a white oil with a kinematic viscosity at 100 degrees C. of 1.5 cSt will preferably have a Noack volatility less than 335; a white oil with a kinematic viscosity at 100 degrees C. of 3 cSt will preferably have a Noack volatility less than 52; and a white oil with a kinematic viscosity at 100 degrees C. of 5 cSt will preferably have a Noack volatility less than 13. A plot of the line defining the preferred upper limit for Noack volatility of the technical or medicinal white oils of this invention is shown in FIG. 2. Noack volatility is defined as the mass of oil, expressed in weight percent, which is lost when the oil is heated at 250 degrees C. and 20 mmHg (2.67 kPa; 26.7 mbar) below atmospheric in a test crucible through which a constant flow of air is drawn for 60 minutes (ASTM D 5800). A more convenient method for calculating Noack volatility and one which correlates well with ASTM D-5800 is by using a thermo gravimetric analyzer test (TGA) by ASTM D 6375-99.

Uses of White Oils:

White oils of this invention will make ideal base oils for personal care and pharmaceutical products. Their inert nature will make them easy to work with, as they lubricate, smooth, soften, extend, and resist moisture in many formulations. They may be blended with USP petrolatum to create a finished USP petrolatum, personal care, and pharmaceutical products with more desired properties. Medicinal grade white oils of this invention may be used in products ranging from baby oils and lotions to sunscreens, tissues, skin adhesives, and antibiotics.

The white oils made from the process of this invention will have utility in applications as wide-ranging as dough divider oils, mold release process oils, and food grade greases, to dust suppression oils in grain silos, animal feeds, insecticides, chemicals, and fertilizers. They will lubricate food-handling equipment; impregnate wrapping paper to keep foods crisp; control foam in beet sugar, vinegar and paper production; and enhance the leather tanning process. Low pour-point white oils will be useful to improve hot melt adhesives, and they may lubricate low temperature equipment such as air conditioners and refrigerator compressors. The white oils produced by this process that have kinematic viscosities greater than about 8.5 cSt are especially suitable for use in food applications. They will be particularly valuable as plasticizer and mold release process oils, as well as 3H release agents, in food applications. 3H release agents are defined by the US Department of Agriculture as substances that may be used on grills, loaf pans, cutters, boning benches, chopping blocks or other hard surfaces to help prevent food from adhering during processing.

White oils of this invention also have excellent oxidation and thermal stability, making them very desirable for high temperature applications. They will provide outstanding long service under adverse conditions. They have excellent UV & color stability and may be employed as internal and/or external lubricants, in polystyrene, polyvinyl chloride, polypropylene, polyethylene, thermoplastic elastomers and numerous other polymer formulations. Examples of thermoplastic elastomers are styrene block copolymer, linear tri-block styrene-ethylene/butylene-styrene block copolymer, polyester, polyamide, polyurethane, polyolefin, halogenated olefin interpolymer alloy, 1,2,polybutadiene, ionomer, fluoroelastomer, and trans-1,4-polyisoprene.

White oils made from the process of this invention are colorless, low staining and odorless, and thus will make excellent textile fiber lubricants, such as knit oils and cotton spindle oils. They will be compatible with wool, cotton, silk, and a wide variety of synthetic textile fibers. In addition they may be used as a paper processing aid, and also as process aids for color stable caulks and sealants. Because they are colorless they will also find application as plasticizers and extenders for very light colored or clear rubbers and plastics. They will make a suitable solvent for colorants. The low-volatility white oils made by the process of this invention will be especially useful as plasticizers in the production of polystyrene, styrene block copolymers, polyolefins, flexible formed polyethylene, thermoplastic elastomers, and various other polymers to improve and control the melt flow rate of the finished polymer. Because they are low staining the white oils made from the process of this invention will find application in stainless hydraulic and aluminum cold rolling oil.

When used as plasticizers in the production of polymers, the white oils of this invention will be used in an amount of 0.1 to 20 parts per weight per 100 parts of polymer. Examples of the use of white oils as plasticizers are given in U.S. Pat. Nos. 6,653,360; 6,632,382 and 4,153,588; and EP1382639A1.

EXAMPLES

Example 1

A hydrotreated Fischer-Tropsch wax made over a cobalt Fischer-Tropsch catalyst, having greater than 80 weight percent n-paraffins, less than 0.8 weight percent oxygen, and a T90 boiling point of 972° F. was selected for hydroisomerization dewaxing into white oil. The hydrotreated Fischer-Tropsch wax had less than 25 ppm total combined nitrogen and sulfur, and less than 25 ppm total combined aluminum, cobalt, titanium, iron, molybdenum, sodium, zinc, tin, and silicon. The hydrotreated Fischer-Tropsch wax had greater than 30 weight percent of molecules having at least 30 carbon atoms. The hydrotreated Fischer-Tropsch wax had a weight ratio of molecules having at least 60 or more carbon atoms and molecules having at least 30 carbon atoms less than 0.05.

Example 2

The hydrotreated Fischer-Tropsch wax described in Example 1 was hydroisomerization dewaxed over a highly selective and active wax hydroisomerization catalyst containing 65 wt % SSZ-32 zeolite and a noble metal hydrogenation component, Pt, on a refractory oxide support. The hydroisomerization dewaxing was conducted at a temperature of 600° F., LHSV of 1 $hr^{-1}$, 300 psig total pressure, and 5,000 SCF/bbl once-through hydrogen. The white oil produced by the hydroisomerization dewaxing passed directly to a second reactor, also at 300 psig total pressure, which contained a Pt/Pd on silica-alumina hydrofinishing catalyst. Conditions in the hydrofinishing reactor were a temperature of 450° F. and LHSV of 2.0 $hr^{1}$. The yield of products boiling at 343 degrees C. and higher (650° F.+) out of the hydrofinishing reactor was about 57 wt % of the hydrotreated Fischer-Tropsch wax feed into the hydroisomerization reactor. The conversion of products boiling at 343 degrees C. and higher (650° F.+) in the Fischer-Tropsch wax to products boiling at 343 degrees C. and lower (650° F.−) was about 32% (there was about 15 wt % 650° F.− in the feed), demonstrating the high activity of the hydroisomerization dewaxing catalyst.

The whole 650° F.+ sample of the hydrofinished product had a kinematic viscosity at 100° C. of 4.794 cSt, a kinematic viscosity at 40° C. of 20.36 cSt, and a pour point of −29° C. The viscosity index of this whole 650° F.+ sample was 166. The viscosity index was greater than an amount calculated by the equation: Viscosity Index=Ln(Kinematic Viscosity at 100° C.)+120=164. After about 400 hours of operating the hydroisomerization and hydrofinishing reactors, the Saybolt color of this whole sample boiling at 650° F. and above was +26. After about 800 hours of operating the hydroisomerization and hydrofinishing reactors the Saybolt color of the whole white oil product boiling at 650° F. and above was +22. All of the products collected from the hydroisomerization dewaxing and hydrofinishing steps met technical white oil specifications.

After 700 hours of operating the hydroisomerization and hydrofinishing reactors, a distillation cut of the product between 730-950° F. was taken. The distillation cut had a kinematic viscosity at 100° C. of 4.547 cSt, a viscosity index of 159, and a pour point of −17° C. The Saybolt color was +29. The viscosity index was greater than an amount calculated by the equation: Viscosity Index=Ln(the Kinematic Viscosity at 100° C.)+115=157.

The unexpected excellent color of the products of this process is attributed in part to the lower temperature required for the highly selective and active wax hydroisomerization catalyst (600° F.), but we believe the excellent color is mainly due to the more restricted crystallographic free diameters of the channels of SSZ-32 compared to SAPO-11. SSZ-32 (but not SAPO-11) has a 1-D 10-ring molecular sieve having channels with a minimum crystallographic free diameter of not less than 3.9 Angstrom and a maximum crystallographic free diameter of not more than 6.0 Angstrom, and no channels with a maximum crystallographic free diameter greater than 6.0 Angstrom. The more restricted crystallographic free diameters of the channels of SSZ-32 limited the formation of ring (or other) structures leading to color. These samples show that even with a very mild hydrofinishing pressure of 300 psig, the process produces oils that meet technical and most medicinal grade white oil specifications. After long hydroisomerization reactor operating times, medicinal grade white oils may be produced in high yields by treating the technical grade white oil by a subsequent hydrofinishing reactor at a slightly higher pressure or by treating the technical grade white oil with a heterogeneous adsorbent.

Example 3

RCS tests were performed on the whole 650° F.+ and 730-970° F. distillation cut white oils described in example 2. Neither of these white oils passed the RCS test. Subsequent hydrofinishing was conducted on these two samples. The hydrofinishing conditions were the same as those used previously except the total pressure was increased from 300 psig to 500 psig or 1000 psig. These white oils prepared by subsequent hydrofinishing at pressures higher than about 325 psig passed the stringent RCS test. The results of the analyses conducted on all of the white oil samples are summarized in Table IV

TABLE IV

| White Oil Inspections | White Oil Samples | | | | |
|---|---|---|---|---|---|
| | Whole Product | | | Distillation Cut | |
| Sample | Whole 650° F.+ | Whole 650° F.+ | Whole 650° F.+ | 730-970° F. | 730-970° F. |
| Hydroisomerization Dewaxing Total Pressure, psig | 300 | 300 | 300 | 300 | 300 |
| Mild Hydrofinishing Total Pressure, psig | 300 | 300 | 300 | 300 | 300 |
| Subsequent Hydrofinishing Total Pressure, psig | None | 500 | 1000 | None | 1000 |
| Pour Point, ° C. | −29 | | | −17 | |
| Viscosity, 40° C., cSt | 20.36 | | | 19.19 | |
| Viscosity 100° C., cSt | 4.794 | | | 4.547 | |
| Viscosity Index | 166 | | | 159 | |
| Saybolt Color | +26 | | | +29 | |
| RCS | Fail | Pass | Pass | Fail | Pass |
| UV, ASTM D2269-99 | | | | | |
| 280-289, nm | 0.54 | | 0.087 | 0.66 | 0.175 |
| 290-299, nm | 0.281 | | 0.073 | 0.654 | 0.151 |
| 300-329, nm | 0.366 | | 0.055 | 0.743 | 0.13 |
| 330-350, nm | 0.15 | | 0.025 | 0.316 | 0.088 |
| Sim. Dist. Wt %, ° F. | | | | | |
| IBP/5 | 584/648 | | | 651/702 | |
| 10/30 | 675/748 | | | 725/783 | |
| 50 | 812 | | | 830 | |
| 70/90 | 898/1027 | | | 878/941 | |
| 95/FBP | 1087/1187 | | | 969/1023 | |
| FIMS Analysis, Wt % | | | | | |
| Paraffins | | | 87.1 | | 86.3 |
| 1 - unsaturations | | | 12.9 | | 13.7 |
| 2 - unsaturations | | | 0 | | 0 |
| 3 - unsaturations | | | 0 | | 0 |
| 4 - unsaturations | | | 0 | | 0 |
| 5 - unsaturations | | | 0 | | 0 |
| 6 - unsaturations | | | 0 | | 0 |
| Total | | | 100.0 | | 100.0 |
| Molecules with Cycloparaffin Functionality, wt % | | | 12.9 | | 13.7 |

Hydrofinishing at a higher pressure was effective at improving the ultraviolet absorbance, and significantly reduced the aromatics, olefins, and color bodies. The samples hydrofinished at pressures greater than about 325 psig for a second time were medicinal grade white oils, suitable for use in food and pharmaceuticals.

These examples demonstrate that a subsequent hydrofinishing step to produce medicinal grade white oils may be accomplished in a single hydrofinishing step when a technical grade white oil is made without mild hydrofinishing using the process of this invention. The total pressure during subsequent hydrofinishing must be selected to be adequate to reduce the UV absorbance to acceptable levels, or to be adequate to change a technical grade white oil that does not pass the RCS test to a medicinal grade white oil that passes the RCS test.

Example 4 (Comparative)

Two different samples of Fe-based Fischer-Tropsch waxes produced by Sasol, prior to hydrotreatment, were analyzed and found to have the properties as summarized in Table V.

TABLE V

| Properties | Fe-Based Fischer-Tropsch Wax | |
|---|---|---|
| | M5 Wax | C80 Wax |
| Sim. Dist., Wt %, ° F. | | |
| 5/10 | 718/739 | 809/840 |
| 20/40 | 761/799 | 875/927 |
| 50 | 816 | 940 |
| 60/80 | 832/878 | 963/1003 |
| 90/95 | 911/940 | 1033/1058 |
| GC Analysis Wt % n-paraffins | 80.73 | 77.02 |
| Nitrogen, ppm | 6 | Not tested |
| Sulfur, ppm | 6 | <6 |
| Oxygen, wt % | 0.136 | 0.23 |

3 parts M5 Wax and 2 parts C80 Wax were blended together to produce a Fischer-Tropsch wax having a T10 boiling point of 756° F., a T90 boiling point of 996° F., less than 0.2 wt % oxygen, and approximately 79 wt % n-paraffins. Neither of the waxes were hydrotreated.

The blend was distilled to remove the higher boiling molecules. The distillation bottoms had a T90 boiling point of 1059° F. The distillation bottoms (waxy feed) were hydroisomerization dewaxed using a less selective and active hydroisomerization catalyst with a noble metal (Pt/SAPO-11) on a refractory oxide support. SAPO-11 is a 1-D 10-ring molecular sieve having channels with a minimum crystallographic free diameter of not less than 3.9 Angstrom, but the maximum crystallographic free diameter of the channels is greater than 6.0 Angstrom.

The weight percent SAPO-11 was 85 wt %. The hydroisomerization dewaxing conditions were 500 psig total reactor pressure, 0.8 LHSV, and a temperature of 650° F. Subsequent hydrofinishing was done over a Pd on silica-alumina catalyst at 1000 psig total pressure and 450° F.

The properties of the lubricating base oil produced by these steps is shown below in Table VI.

TABLE VI

| Properties | Comparative Example 4 Base Oil |
|---|---|
| Viscosity at 100° C., cSt | 8.144 |
| Viscosity Index | 158 |
| Pour Point, ° C. | −28 |
| Saybolt Color | +27 |
| UV Absorbance | |
| 280-289 nm | 0.007 |
| 290-299 nm | 0.005 |
| 300-329 nm | 0.001 |
| 330-380 nm | <0.001 |
| FIMS | |
| Paraffins | 81.0 |
| 1 - unsaturations | 16.3 |
| 2 - unsaturations | 1.9 |
| 3 - unsaturations | 0.0 |
| 4 - unsaturations | 0.0 |
| 5 - unsaturations | 0.0 |
| 6 - unsaturations | 0.8 |
| Total | 100.0 |
| Molecules with Cycloparaffin Functionality, wt % | 19.0 |

This comparative white oil example, Comparative Example 4 Base Oil, was made with a molecular sieve (SAPO-11) with a maximum crystallographic free diameter exceeding the maximum crystallographic free diameter of not more than 6.0 Angstrom of the highly selective and active wax hydroisomerization catalysts of this invention. It was hydrofinished under high pressure (1000 psig) to yield the white oil with good Saybolt color and low UV absorbance. Note that the VI of this white oil is low compared to the preferred white oils of the current invention. The VI is considerably less than an amount calculated by the equation: VI=28×Ln(Kinematic Viscosity at 100° C.)+105=164. This white oil does not have the desired composition of molecules with cycloparaffin functionality of this invention.

Example 5 (Comparative)

A hydrotreated Co-based Fischer-Tropsch wax having a T90 boiling point of greater than 950° F. was hydroisomerization dewaxed using a molecular sieve (Pt/SAPO-11) with a maximum crystallographic free diameter exceeding the maximum crystallographic free diameter of not more than 6.0 Angstrom of the highly selective and active wax hydroisomerization catalysts of this invention. The hydroisomerization dewaxing conditions were 300 psig total reactor pressure and a temperature of approximately 660 to 680° F. Subsequent hydrofinishing was done over a Pd on silica-alumina catalyst at 300 psig total pressure and 450° F. A distillation of the full boiling range product was made and a sample with a boiling range between 730 to 930° F. was collected.

The properties of the lubricating base oil produced by these steps are shown below in Table VII.

TABLE VII

| Properties | Comparative Example 5 Base Oil |
|---|---|
| Viscosity at 100° C., cSt | 4.3 |
| Viscosity Index | 147 |
| Pour Point, ° C. | −17 |
| Saybolt Color | −1 |
| Wt % Aromatics | 3.0 |
| FIMS, wt % | |
| Paraffin | 87.0 |
| 1 - unsaturations | 10.0 |
| 2 - unsaturations | 0.0 |
| 3 - unsaturations | 0.0 |
| 4 - unsaturations | 3.0 |
| 5 - unsaturations | 0.0 |
| 6 - unsaturations | 0.0 |
| Total | 100.0 |
| Molecules with Cycloparaffinic Functionality, Wt % | 10.0 |

The Comparative Example 5 Base Oil shows how hydrofinishing under low pressure was not effective at removing the aromatics and color from the lubricating base oil that was hydroisomerization dewaxed using Pt/SAPO-11. This sample would not qualify as a white oil due to it having a dark color and high aromatics content.

Example 6 (Comparative)

A hydrotreated Fischer-Tropsch wax (Table VIII, below) was isomerized over a Pt/SSZ-32 catalyst which contained 0.3% Pt and 35% Catapal alumina binder. Note that the T90 boiling point of the wax feed was less than 915° F. Run conditions were 560° F. hydroisomerization temperature, 1.0 LHSV, 300 psig total reactor pressure, and a once-through hydrogen rate of 6,000 SCF/bbl. The reactor effluent passed directly to a second mild hydrofinishing reactor, also at 300 psig total pressure, which contained a Pt/Pd on silica-alumina hydrofinishing catalyst. Conditions in that reactor were a temperature of 450° F. and LHSV of 1.0. Conversion and yields, as well as the properties of the hydroisomerized stripper bottoms (Comparative Example 6 Base Oil) are given in Table IX.

TABLE VIII

| Hydrotreated Fischer-Tropsch Wax | |
|---|---|
| Gravity, API | 40.3 |
| Nitrogen, ppm | 1.6 |
| Sulfur, ppm | 2 |
| Sim. Dist., Wt %, ° F. | |
| IBP/5 | 512/591 |
| 10/30 | 637/708 |
| 50 | 764 |
| 70/90 | 827/911 |
| 95/FBP | 941/1047 |

TABLE IX

| Preparation of Hydroisomerized Stripper Bottoms | |
|---|---|
| Hydroisomerization of FT Wax over Pt/SSZ-32 at 560° F., 1 LHSV, 300 psig, and 6 MSCF/bbl H2 | |
| Conversion 650° F.+ to 650° F.−, Wt % | 15.9 |
| Conversion 700° F.+ to 700° F.−, Wt % | 14.1 |
| Yields, Wt % | |
| C1-C2 | 0.11 |
| C3-C4 | 1.44 |
| C5-180° F. | 1.89 |
| 180-290° F. | 2.13 |
| 290-650° F. | 21.62 |
| 650° F.+ | 73.19 |
| Hydroisomerized Stripper Bottoms (Comparative Example 6 Base Oil): | |
| Yield, Wt % of Feed | 75.9 |
| Sim. Dist., LV %, ° F. | |
| IBP/5 | 588/662 |
| 30/50 | 779/838 |
| 95/99 | 1070/1142 |
| Pour Point, ° C. | +25 |

The pour point of the Comparative Example 6 Base Oil was too high to be considered a good quality white oil. This example used a feed with a lower T90 boiling point (911 degrees F.) than the waxy feed of this invention that has a T90 boiling point greater than 490 degrees C. (915 degrees F.). The level of conversion in the combined hydroisomerization and hydrofinishing steps was also inadequate to reduce the pour point below 0° C. This example also did not have the preferred level of conversion of the 650° F.+ products in the Fischer-Tropsch waxy feed to products boiling at 650° F.− of greater than 20 wt % and less than 75 wt %.

All of the publications, patents and patent applications cited in this application are herein incorporated by reference in their entirety to the same extent as if the disclosure of each individual publication, patent application or patent was specifically and individually indicated to be incorporated by reference in its entirety.

Many modifications of the exemplary embodiments of the invention disclosed above will readily occur to those skilled in the art. Accordingly, the invention is to be construed as including all structure and methods that fall within the scope of the appended claims.

What is claimed is:

1. A process for producing one or more white oils, comprising:

a. hydroisomerization dewaxing a waxy feed over a highly selective and active wax hydroisomerization catalyst under conditions sufficient to produce a white oil;

i. wherein the highly selective and active wax hydroisomerization catalyst has:

1). a 1-D 10-ring molecular sieve having channels with a minimum crystallographic free diameter of not less than 3.9 Angstrom and a maximum crystallographic free diameter of not more than 6.0 Angstrom, and no channels with a maximum crystallographic free diameter greater than 6.0 Angstrom;

2). a noble metal hydrogenation component; and 3) a refractory oxide support; and ii. wherein the waxy feed has:

1). a T90 boiling point greater than 490 degrees C. (915 degrees F.);

2). greater than 40 weight percent n-paraffins; and

3). less than 25 ppm total combined nitrogen and sulfur; and iii. wherein the hydroisomerization dewaxing is done directly on the waxy feed, without a separate hydrocracking step; and b. collecting one or more white oils from the hydroisomerization dewaxing step, wherein i. the yield of the one or more white oils boiling from 343 degrees C. and above (650° F.+) is greater than 25 weight percent of the waxy feed; and ii. the one or more white oils produced have a pour point less than zero degrees C. and a Saybolt color of +20 or greater.

2. The process of claim 1 wherein the waxy feed comprises a Fischer-Tropsch wax.

3. The process of claim 1, wherein the waxy feed has greater than 50 weight percent n-paraffins.

4. The process of claim 3, wherein the waxy feed has greater than 75 weight percent n-paraffins.

5. The process of claim 1, wherein the waxy feed has a T90 boiling point greater than 510 degrees C. (950 degrees F.).

6. The process of claim 5, wherein the waxy feed has a T90 boiling point greater than 565 degrees C. (1050 degrees F.).

7. The process of claim 1, wherein the waxy feed additionally has:

a. less than 1.0 weight percent oxygen; and b. less than 25 ppm total combined aluminum, cobalt, titanium, iron, molybdenum, sodium, zinc, tin, and silicon.

8. The process of claim 7, wherein the waxy feed has:

a. greater than 50 weight percent n-paraffins;

b. less than 0.8 weight percent oxygen;

c. less than 20 ppm total combined nitrogen and sulfur; and d. less than 20 ppm total combined aluminum, cobalt, titanium, iron, molybdenum, sodium, zinc, tin, and silicon.

9. The process of claim 8, wherein the waxy feed has greater than 75 weight percent n-paraffins.

10. The process of claim 1, wherein the noble metal hydrogenation component is a Group VIII noble metal.

11. The process of claim 10, wherein the Group VIII noble metal is platinum, palladium, or mixtures thereof.

12. The process of claim 1, wherein the 1-D 10-ring molecular sieve has channels with:

a. a minimum crystallographic free diameter of not less than 3.9 Angstrom and a maximum crystallographic free diameter of not more than 5.7 Angstrom.

13. The process of claim 12, wherein the 1-D 10 ring molecular sieve has channels with a minimum crystallographic free diameter of not less than 3.9 Angstrom and a maximum crystallographic free diameter of not more than 5.4 Angstrom.

14. The process of claim 1, wherein the molecular sieve is selected from the group consisting of ZSM48, MTT, TON, EUO, MFS, FER group types of molecular sieves, and mixtures thereof.

15. The process of claim 14, wherein the molecular sieve is selected from the group consisting of SSZ-32, ZSM-23, ZSM-22, ZSM-35, ZSM48, ZSM-57, and mixtures thereof.

16. The process of claim 15, wherein the molecular sieve is SSZ-32, ZSM-23, ZSM-22, or mixtures thereof.

17. The process of claim 1, wherein the hydroisomerization dewaxing is conducted at a hydrogen partial pressure from about 0.1 MPa (14.5 psia) to less than about 6.55 MPa (950 psia).

18. The process of claim 17, wherein the hydroisomerization dewaxing is conducted at a hydrogen partial pressure of from about 1.38 MPa (200 psia) to less than about 5.52 MPa (800 psia).

19. The process of claim 18, wherein the hydrogen partial pressure is from about 1.72 MPa (250 psia) to less than about 3.45 MPa (500 psia).

20. The process of claim 1, wherein the hydroisomerization dewaxing is conducted at a temperature below about 357 degrees C. (675 degrees F.).

21. The process of claim 1, wherein the conversion of the hydrocarbons in the waxy feed boiling at 343° C. and higher (650° F.+) to products boiling at 343° C. and lower (650° F.−) during the hydroisomerization dewaxing and any following process steps is greater than 20 wt % and less than 75 wt %.

22. The process of claim 1, wherein the yield of the one or more white oils boiling from 343 degrees C. and above (650° F.+) is greater than 35 wt % of the waxy feed.

23. The process of claim 22, wherein the yield of the one or more white oils boiling from 343 degrees C. and above (650° F.+) is greater than 45 wt % of the waxy feed.

24. The process of claim 1, wherein the one or more white oils produced have a pour point less than −10 degrees C.

25. The process of claim 1, wherein the one or more white oils produced have a viscosity index greater than an amount calculated by the equation: Viscosity Index=28×Ln(the Kinematic Viscosity at 100° C.)+95; wherein the kinematic viscosity of the one or more white oils produced is between about 1.5 cSt and 36 cSt.

26. The process of claim 25, wherein the one or more white oils produced have a viscosity index greater than an amount calculated by the equation: Viscosity Index=28×Ln(the Kinematic Viscosity at 100° C.)+105.

27. The process of claim 1, additionally comprising mild hydrofinishing of the one or more white oils collected after hydroisomerization dewaxing at a total pressure less than 3.45 MPA (500 psig).

28. The process of claim 27, wherein the total pressure during mild hydrofinishing is from about 1.382 MPa (200 psig) to about 3.45 MPa (500 psig).

29. The process of claim 1, additionally comprising contacting the collected one or more white oils with a heterogeneous adsorbent.

30. The process of claim 1, additionally comprising distilling the collected one or more white oils to remove a high boiling bottoms cut.

31. The process of claim 30, additionally comprising contacting the high boiling bottoms cut with a heterogeneous adsorbent.

32. A process for producing one or more medicinal grade white oils, comprising:

a. hydroisomerization dewaxing a waxy feed over a highly selective and active wax hydroisomerization catalyst under conditions sufficient to produce a white oil;

i. wherein the highly selective and active wax hydroisomerization catalyst has a 1-D 10-ring molecular sieve having channels with a minimum crystallographic free diameter of not less than 3.9 Angstrom and a maximum crystallographic free diameter of not more than 6.0 Angstrom, and no channels with a maximum crystallographic free diameter greater than 6.0 Angstrom; and ii. wherein the waxy feed has:

1. a T90 boiling point greater than 490 degrees C. (915 degrees F.);

2. greater than 40 weight percent n-paraffins; and 3. less than 25 ppm total combined nitrogen and sulfur; and iii. wherein the hydroisomerization dewaxing is done directly on the waxy feed, without a separate hydrocracking step; and b. collecting one or more technical grade white oils from the hydroisomerization dewaxing step, wherein i. the yield of the one or more technical grade white oils boiling from 343 degrees C. and above (650° F.+) is greater than 25 weight percent of the waxy feed; and ii. the one or more technical grade white oils produced have a pour point less than zero degrees C. and a Saybolt color of +20 or greater; and c. hydrofinishing the one or more technical grade white oils at conditions sufficient to produce one or more medicinal grade white oils that pass the RCS test.

33. The process of claim 32, wherein the hydrofinishing is conducted using a hydrofinishing catalyst comprising a noble metal.

34. The process of claim 33, wherein the noble metal is platinum, palladium, or mixtures thereof.

35. The process of claim 32, wherein the hydrofinishing is conducted at a total pressure of greater than about 325 psig.

36. A process for producing one or more white oils, comprising:

a. hydroisomerization dewaxing a waxy feed over a highly selective and active wax hydroisomerization catalyst under conditions sufficient to produce a white oil;

i. wherein the highly selective and active wax hydroisomerization catalyst has:

1). a 1-D 10-ring molecular sieve having channels with a minimum crystallographic free diameter of not less than 3.9 Angstrom and a maximum crystallographic free diameter of not more than 6.0 Angstrom, and no channels with a maximum crystallographic free diameter greater than 6.0 Angstrom;

2). a noble metal hydrogenation component; and

3). a refractory oxide support; and ii. wherein the waxy feed has:

1). a T90 boiling point greater than 490 degrees C. (915 degrees F.);

2). greater than 40 weight percent n-paraffins; and

3). less than 25 ppm total combined nitrogen and sulfur; and b. collecting one or more white oils from the hydroisomerization dewaxing step, wherein i. the yield of the one or more white oils boiling from 343 degrees C. and above (650° F.+) is greater than 25 weight percent of the waxy feed; and ii. the one or more white oils produced have a pour point less than zero degrees C, a Saybolt color of +20 or greater, and a viscosity index greater than an amount calculated by the equation: Viscosity Index=28×Ln (Kinematic Viscosity at 100° C.)+95.

37. A process for producing one or more white oils, comprising:

a. hydroisomerization dewaxing a waxy feed over a highly selective and active wax hydroisomerization catalyst under conditions sufficient to produce a white oil;

i. wherein the highly selective and active wax hydroisomerization catalyst has a 1-D 10-ring molecular sieve having channels with a minimum crystallographic free diameter of not less than 3.9 Angstrom and a maximum crystallographic free diameter of not more than 6.0 Angstrom, and no channels with a maximum crystallographic free diameter greater than 6.0 Angstrom; and ii. wherein the waxy feed has greater than 40 weight percent n-paraffins and a weight ratio of molecules having at least 60 or more carbon atoms and molecules having at least 30 carbon atoms less than 0.05; and b. collecting one or more white oils from the hydroisomerization dewaxing step, wherein the one or more white oils produced have a viscosity index greater than an amount calculated by the equation: Viscosity Index=28×Ln(Kinematic Viscosity at 100° C.)+95.

38. A process for producing one or more white oils, comprising:

a. hydroisomerization dewaxing a waxy feed over a highly selective and active wax hydroisomerization catalyst under conditions sufficient to produce a white oil;

i. wherein the highly selective and active wax hydroisomerization catalyst has:

1). a 1-D 10-ring molecular sieve having channels with a minimum crystallographic free diameter of not less than 3.9 Angstrom and a maximum crystallographic free diameter of not more than 6.0 Angstrom, and no channels with a maximum crystallographic free diameter greater than 6.0 Angstrom;

2). a noble metal hydrogenation component; and

3). a refractory oxide support; and ii. wherein the waxy feed has:

1). a T90 boiling point greater than 490 degrees C. (915 degrees F.);

2). greater than 40 weight percent n-paraffins; and

3). less than 25 ppm total combined nitrogen and sulfur;

b. collecting one or more white oils from the hydroisomerization dewaxing step, wherein i. the yield of the one or more white oils boiling from 343 degrees C. and above (650° F.+) is greater than 25 weight percent of the waxy feed; and ii. the one or more white oils produced have a pour point less than zero degrees C., a Saybolt color of +20 or greater, and a viscosity index greater than an amount calculated by the equation: Viscosity Index=28×Ln (Kinematic Viscosity at 100° C.)+95.

39. The process of claim 38, wherein the one or more white oils produced have a viscosity index greater than an amount calculated by the equation: Viscosity Index=28×Ln(Kinematic Viscosity at 100° C.)+105.

* * * * *